United States Patent [19]

von Blücher et al.

[11] Patent Number: 4,457,345

[45] Date of Patent: Jul. 3, 1984

[54] BLENDED YARN CONTAINING ACTIVE CARBON STAPLE FIBERS, AND FABRIC WOVEN THEREFROM

[76] Inventors: Hubert von Blücher, Freytagstrasse 45; Hasso von Blücher, Sohnstrasse 58, both of D-4000, Dusseldorf, Fed. Rep. of Germany; Ernest de Ruiter, Höhenstrasse 57A, D-5090 Leverkusen 3, Fed. Rep. of Germany

[21] Appl. No.: 441,693

[22] Filed: Nov. 15, 1982

[30] Foreign Application Priority Data

Nov. 14, 1981 [DE] Fed. Rep. of Germany ..... 3145267

[51] Int. Cl.[3] ..... D03D 15/00; D02G 3/04; D02G 3/44

[52] U.S. Cl. ..... 139/420 R; 57/252; 57/255

[58] Field of Search ..... 57/200, 403, 252, 249, 57/255, 904, 256; 428/367, 359; 423/447.1, 447.2; 139/420 R, 426 R

[56] References Cited

U.S. PATENT DOCUMENTS

| | | | |
|---|---|---|---|
| 3,648,451 | 3/1972 | Riley | 57/403 X |
| 3,744,534 | 7/1973 | Henry et al. | 57/904 X |
| 3,866,405 | 2/1975 | Knopka | 57/255 |
| 4,014,725 | 3/1977 | Schulz | 428/367 X |
| 4,159,618 | 7/1979 | Sokaris | 57/249 X |
| 4,285,831 | 8/1981 | Yoshida et al. | 428/367 X |
| 4,331,729 | 5/1982 | Weber | 57/904 X |
| 4,347,279 | 8/1982 | Saji et al. | 428/367 X |

*Primary Examiner*—Donald Watkins
*Attorney, Agent, or Firm*—Sprung, Horn, Kramer & Woods

[57] ABSTRACT

A yarn is prepared from a mixture of textile staple fibers and active carbon staple fibers which consists of 5 to 75%, preferably 20 to 40%, of the latter by weight, by chopping active carbon monofilaments into staple fibers, mixing them with textile staple fibers in a liquid vehicle, separating the fibers from the liquid vehicle and spinning them to yarn which can be used in weaving fabrics of tensile strengths of as much as 2000 newtons per 5 centimeters, which in turn can be used in making filters and protective suits.

13 Claims, No Drawings

BLENDED YARN CONTAINING ACTIVE CARBON STAPLE FIBERS, AND FABRIC WOVEN THEREFROM

BACKGROUND OF THE INVENTION

Active carbon is used, especially in granular form, for a great variety of purposes, such as for example in installations for the recovery of solvent vapors, in filter systems for decolorizing liquids, in deodorizing filters in exhaust hoods, in medical applications, in gas mask filters, and in ABC protective suits.

Woven and nonwoven fabrics of active carbon have recently been marketed for use in filters. In fiber form, active carbon is especially effective on account of the favorable ratio of surface to volume, which improves the accessibility of the pores. These woven and nonwoven active carbon fabrics are produced by carbonizing fabrics of materials containing carbon and then activating them with steam, but they are never produced by the fabrication of individual carbon fibers. The advantage of the high adsorptive power of such filter materials is counterbalanced by the disadvantage of their very limited mechanical strength. Consequently, they are suitable under certain circumstances for fixed installations, but not, for example, for protective suiting against chemical warfare agents.

It is the object of the invention to combine the advantages of active carbon fibers with the mechanical strength of a fabric of noncarbonized fibers.

SUMMARY OF THE INVENTION

This object is achieved by a blended yarn consisting of 5 to 75%, especially 20 to 40%, by weight, of active carbon staple fibers, and the balance of textile staple fibers, and by fabrics woven from this blended yarn.

The blended yarn of the invention is made by chopping cable or tow of monofilaments of active carbon, known in itself, into staple fibers, gently mixing them with textile staple fibers, and spinning them into yarn. It is desirable for the active carbon staple fibers to have a length of 1 to 10 cm. To prevent these staple fibers from being broken when they are mixed with the other textile fibers used in making the blended yarn and enable them to retain their original length, the active carbon staple fibers are best mixed with the other staple fibers of comparable length in a liquid vehicle, especially water or an aqueous fluid. It is best to let the active carbon staple fibers fall, after being cut from a cable consisting usually of 10,000 to several hundreds of thousands of individual filaments, into a bath into which the textile individual filaments are simultaneously fed. Additional measures can be taken to mix the staple fibers together in the liquid vehicle, but in many cases a sufficient mixing of the different staple fibers is accomplished when the liquid vehicle is removed and they are spun into the blended yarn.

The textile fibers which are to be spun with the active carbon staple fibers into blended yarns can be any of a great variety of natural or synthetic, organic or inorganic fibers, such as for example cotton, wool, silk, polyester, polyamide or aramide fibers, glass fibers, or other mineral fibers. Polyamide, polyester or aramide fibers are preferred for the production of the blended yarns of the invention. The textile staple fibers of the blended fabric can consist of a fire-retardant synthetic polymer or they can be treated for fire-retardancy.

The active carbon staple fibers have as a rule a fineness of 0.5 to 20 dtex, especially 1 to 5 dtex. The fineness of the textile fibers is, as a rule, of the same order of magnitude. The blend of the active carbon staple fibers with the textile staple fibers can be spun in a known manner into blended yarns, and these in turn can easily be woven. The blended yarn containing the active carbon staple fibers can be used either in the filling alone, in the warp alone, or both in the filling and in the warp, depending on the desired application. If a textile yarn is used for the warp or filling only, it does not have to be made of the same material as the textile staple fibers of the blended yarn, but can be adapted to the particular application for which the fabric is to be used.

To enable the fabric woven from the blended yarn containing active carbon staple fibers fully to perform their filtering action, the fabrics should have an air permeability of 10 to 1000, especially 150 to 300, liters per minute per 100 $cm^2$ at 1 mbar of vacuum. Such permeability can be achieved by the weaving of a loose yarn, which can then be tightly beaten up, or by weaving an open fabric.

Regardless of the air permeability, the fabric should have a tensile strength of 100 to 20,000, especially 200 to 2,000, newtons per 5 cm, which can be achieved either by the selection of sufficiently strong staple fibers for the blended yarn, or by weaving together with other yarns of very high tensile strength.

The specific weight of the blended fabrics can extend from 50 to 1500 grams per square meter, and for most applications a specific weight of 200 to 400 $g/m^2$ is preferred.

All-in-all, the fabrics of the invention are distinguished by outstanding textile properties and good strength, and, with regard to their active carbon fiber content, their adsorption activity has not been found inferior to that of fabrics of pure active carbon fibers.

The fabrics made in accordance with the invention from blended yarns containing active carbon staple fibers are used preferentially for making filters. On account of their better mechanical properties they are more versatile and stronger than filters made by the carbonization of woven fabrics. The good textile properties and strengths of the woven fabrics of the invention enable them to be used in the production of protective suits, especially suits for industrial or military purposes, i.e., for protection against chemicals or chemical warfare agents.

EXAMPLE

Preoxidized polyacrylonitrile fibers of 1.5 dtex were carbonized in a known manner in the form of a cable of 320,000 individual filaments, and then activated with steam in an oven suitable for this purpose. This resulted in a cable of active carbon fibers of good mechanical properties and with a BET surface area, measured with nitrogen, of 350 square meters per gram.

Cellulose fibers were carbonized and activated in like manner. Their BET surface area, measured with nitrogen, amounted to 1100 $m^2/g$. The high activity is gained at the expense of mechanical strength, but nevertheless the fibers withstand the procedure described below for incorporating them into a blended yarn and then weaving the yarn.

Also, carbon fibers of 18 dtex made from pitch were activated with steam. The BET surface area measured with nitrogen amounted to 800 $m^2/g$ with adequate strength.

Staple fibers of 3 cm length were cut from the cables of active carbon fibers. One part by weight of these active carbon staple fibers was mixed in water with two parts by weight of a polyester staple fiber also of 3 cm length and 1 dtex, and then spun to form blended yarns of about 70 dtex, which then were made into woven fabrics of a weight per unit area of about 280 g/m$^2$ having mechanical properties equal to those of similar polyester blends made with wool and with staple fiber. The activity of the active carbon fibers was not affected by the spinning of the blended yarn or by the weaving of the blended fabric.

It will be understood that the specification and examples are illustrative but not limitative of the present invention and that other embodiments within the spirit and scope of the invention will suggest themselves to those skilled in the art.

We claim:

1. A blended yarn of staple fibers comprising by weight about 5 to 75% of active carbon staple fibers and about 95 to 25% of textile staple fibers, the active carbon fibers having a surface area of 350 to 1100 m$^2$/g and having been produced by cutting a tow of active carbon monofilaments.

2. A blended yarn according to claim 1, wherein the active carbon staple fibers have a fineness of about 0.5 to 20 dtex.

3. A blended yarn according to claim 1, wherein the textile fiber is a polyamide, polyester or aramide fiber.

4. A blended yarn according to claim 1, wherein the textile fiber is fire-retardant or treated for fire-retardancy.

5. A blended yarn according to claim 1, wherein the active carbon staple fibers have a length of about 1 to 10 cm.

6. A blended yarn according to claim 4, comprising by weight about 20 to 40% of active carbon staple fibers blended with a polyamide, polyester or aramide fiber, the active carbon fibers having a fineness of about 1 to 5 dtex and a length of about 1 to 10 cm.

7. A blended yarn according to claim 1, made by mixing the carbon fibers cut from the tow with the textile staple fibers in a liquid vehicle, separating the fiber blend from the liquid vehicle, and spinning the blend into a yarn.

8. A blended yarn according to claim 1 in the form of at least one of the warp and filling of a woven fabric.

9. A woven fabric according to claim 8, having an air permeability of about 10 to 1,000 l/min·100 cm$^2$ at 1 mbar vacuum.

10. A woven fabric according to claim 9, having a tensile strength of about 100 to 20,000 N/b cm.

11. A woven fabric according to claim 10, having a weight per unit area of about 50 to 1500 g/m$^2$.

12. A filter having as its filter element a woven fabric according to claim 8.

13. A protective suit at least in part made up of a woven fabric according to claim 8.

* * * * *